United States Patent [19]

Kim, Jr. et al.

[11] Patent Number: 4,579,088

[45] Date of Patent: Apr. 1, 1986

[54] OPEN CHANNEL STEAM GENERATOR FEEDWATER SYSTEM

[75] Inventors: Roy F. Kim, Jr., Ross Twp., Allegheny Co.; Min-Hsiung Hu, Murrysville, both of Pa.

[73] Assignee: Westinghouse Electric Corp., Pittsburgh, Pa.

[21] Appl. No.: 597,904

[22] Filed: Apr. 9, 1984

[51] Int. Cl.[4] ..... F22B 1/02

[52] U.S. Cl. ..... 122/34; 122/32; 122/438; 165/159; 165/161

[58] Field of Search ..... 122/32, 33, 34, 438; 165/159, 161

[56] References Cited

U.S. PATENT DOCUMENTS 3,991,720 11/1976 Byerley .

4,037,569 7/1977 Bennett et al. .

4,307,685 12/1981 Robin et al. ..... 122/32

4,462,340 7/1984 Mayer ..... 122/34

*Primary Examiner*—Edward G. Favors

*Attorney, Agent, or Firm*—R. P. Lenart

[57] ABSTRACT

A vapor generator which utilizes a primary fluid to vaporize a secondary fluid is provided with an open flow channel and elevated discharge nozzle for the introduction of secondary fluid. The discharge nozzle is positioned above a portion of the inlet line such that a vertical section of inlet line is filled with secondary fluid prior to discharge into the open channel. In and around the open channel, incoming secondary fluid mixes with recirculated fluid before being discharged through the top of the channel and passed through a tube bundle where it is vaporized.

6 Claims, 3 Drawing Figures

OPEN CHANNEL STEAM GENERATOR FEEDWATER SYSTEM

BACKGROUND OF THE INVENTION

This invention relates to steam generators for nuclear power plants and more particularly to vertical steam generators having a feedwater inlet structure disposed in the upper portion thereof.

Vertical steam generators include a tube bundle positioned within a shell structure and encircled by a wrapper. An annular passage is formed between the wrapper and the shell. Feedwater which is introduced into the upper portion of the shell travels down the annular passage and up through the tube bundle where it is heated by primary fluid passing through the tubes. In certain steam generators, the feedwater is introduced into a feedwater inlet ring positioned above the tube bundle. Initial feedwater ring designs discharged the feedwater through holes in the bottom of the ring. This created a potential steam trap in the top of the ring that could lead to bubble collapse waterhammer, which is a rapid depressurization of a steam void caused by the introduction of cold water into the void. That feedwater ring design was modified to provide for top discharge through J-nozzles. This permitted steam to rise out of the ring and also retained the desirable feature of directing feedwater toward the tube sheet in the wrapper/shell annulus thereby distributing feedwater in desired proportions at the feed ring elevation. Examples of bottom discharge and J-tube feed rings can be found in U.S. Pat. Nos. 4,037,569, issued July 26, 1977, to Bennett et al, and 3,991,720, issued Nov. 16, 1976, to Byerley, respectively.

In either feedwater ring design, feedwater line and nozzle flow stratification can occur due to thermal and hydraulic mechanisms. The thermal mechanism involves the heating of feedwater along the feed ring. Once the feedwater enters the steam generator, it receives heat through ring wall heat conduction. Then the buoyancy force becomes significant such that in a J-tube feed ring, feedwater may discharge through some of the J-tubes while hot water enters the ring through other J-tubes. The hydraulic mechanism is the main factor for feed ring flow stratification in feed rings with bottom hole discharge. In that case, feedwater enters the steam generator and discharges through some of the bottom holes while hot water gets into the ring via other bottom holes.

SUMMARY OF THE INVENTION

The present invention seeks to avoid bubble collapse waterhammer and to minimize flow stratification and thermal shock in the pressurized boundary components. This is accomplished through the use of an open channel feedwater system having an elevated discharge pipe. A vapor generator which utilizes a primary fluid to vaporize a secondary fluid and is constructed in accordance with the present invention comprises: a vertically oriented sheel portion; a plurality of U-shaped tubes forming a tube bundle and disposed within the shell portion; a tube sheet having a plurality of openings disposed therein for receiving the ends of the tubes; a wrapper encircling the tube bundle and forming an annular passage adjacent to the shell; an inlet line for introducing the secondary fluid into the shell portion and having a generally horizontal section; a discharge nozzle for the secondary fluid, in fluid communication with the inlet line and elevated above the generally horizontal section of the inlet line; and a channel positioned above the tube bundle for receiving the secondary fluid from the inlet nozzle. The channel has an open top portion which is in fluid communication with the annular passage.

DESCRIPTION OF THE PREFERRED EMBODIMENT

Figure 1:
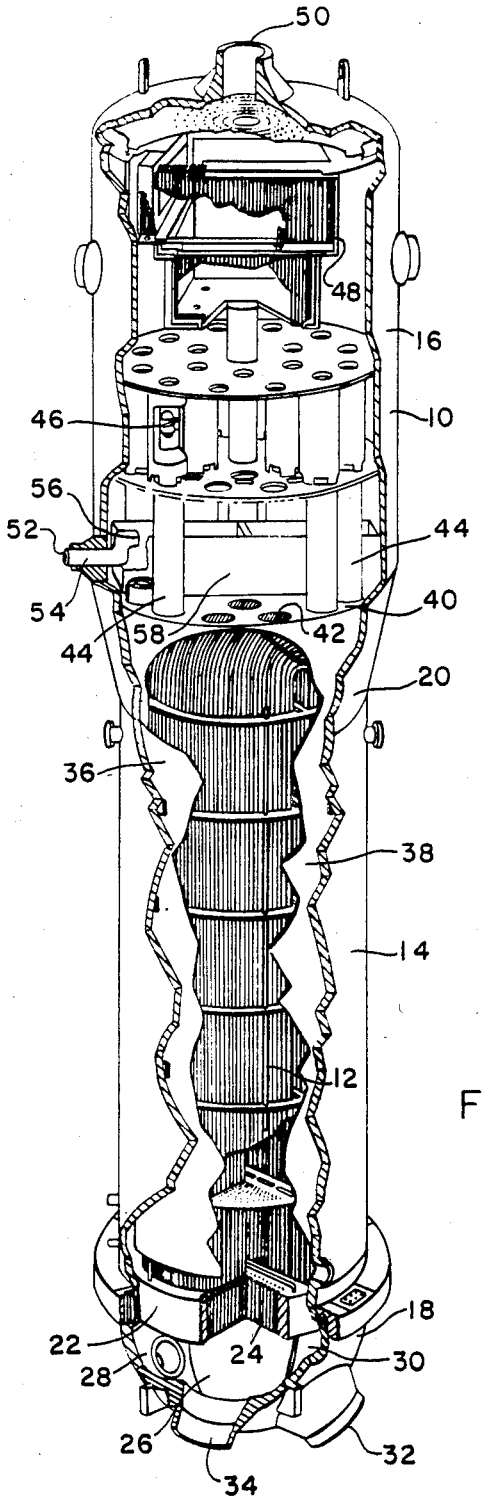
FIG. 1 is an elevation view of a vertical steam generator constructed in accordance with one embodiment of the present invention.

Referring now to the drawings, FIG. 1 shows a steam or vapor generator 10 that utilizes a plurality of U-shaped tubes which form a tube bundle 12 to provide the heating surface required to transfer heat from a primary fluid to vaporize or boil a secondary fluid. The steam generator 10 comprises a vessel having a vertically oriented tubular shell portion 14 and an enclosure or flanged and dished head 16 enclosing the upper end and a spherically shaped channel head 18 enclosing the lower end. The lower shell portion 14 is smaller in diameter than the upper portion 16 and a frustoconical-shaped transition member 20 connects the upper and lower portions. A tube sheet 22 is made integral with the channel head 18 and has a plurality of holes 24 disposed therein to receive ends of the U-shaped tubes. A dividing plate 26 is centrally disposed within the channel head 18 to divide the channel head into two compartments 28 and 30 which serve as headers for the tube bundle. Compartment 30 is the primary fluid inlet compartment and has a primary fluid inlet nozzle 32 in fluid communication therewith. The compartment 28 is the primary fluid outlet compartment and has a primary fluid outlet nozzle 34 in fluid communication therewith. Thus, primary fluid which enters fluid compartment 30 is caused to flow through the tube bundle 12 and out through outlet nozzle 34.

The tube bundle 12 is encircled by a wrapper 36 which forms an annular passage 38 between the wrapper 36 and the shell portion 14. The top of wrapper 36 is covered by a lower deck plate 40 which includes a plurality of openings 42 in fluid communication with a plurality of riser tubes 44. Swirl vanes 46 are disposed within the riser tubes to cause steam flowing therethrough to spin and centrifugally remove some of the moisture contained therein as it flows through the centrifugal separator. After flowing through the centrigual separator, the steam passes through a chevron-type separator 48 before reaching a secondary fluid steam outlet nozzle 50 centrally disposed in the shell portion 16.

The feedwater inlet structure of this steam generator includes a feedwater inlet line 52 having a generally horizontal portion 54 and a discharge nozzle 56 elevated above the generally horizontal portion. A channel 58 which is positioned above the steam generator tube bundle and adjacent to lower deck plate 40 receives secondary fluid from the discharge nozzle 56 and has an open top portion which is in fluid communication with the annular passage 38.

Feedwater which is supplied through the feedwater inlet line 52 is introduced through the elevated discharge nozzle 56 into the open channel 58 where it cascades over the top of the open channel and then mixes with moisture which has separated from the steam and is being recirculated. The mixture then flows down into annular passage 38.

Figure 2:
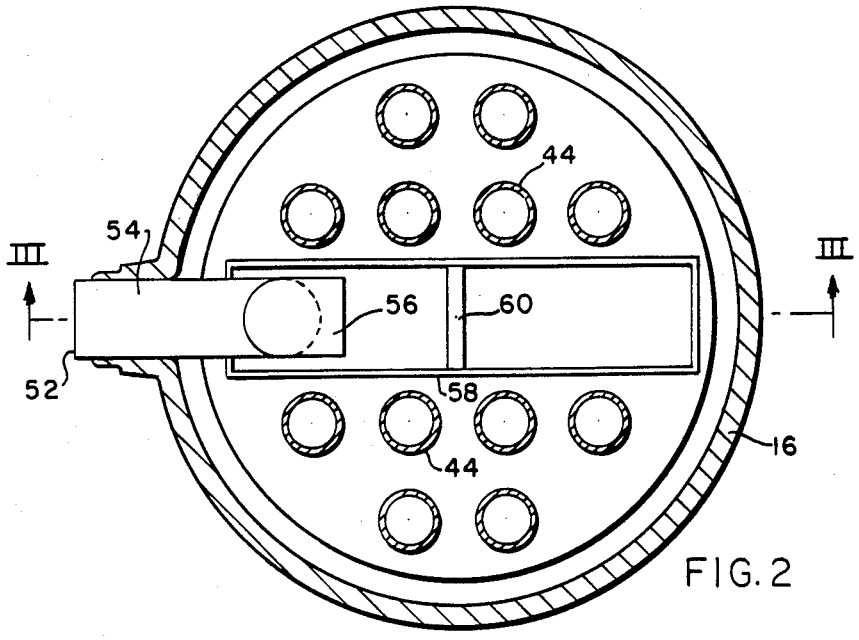
FIG. 2 is a plan view of a feedwater inlet structure constructed in accordance with one embodiment of the present invention.
Figure 3:
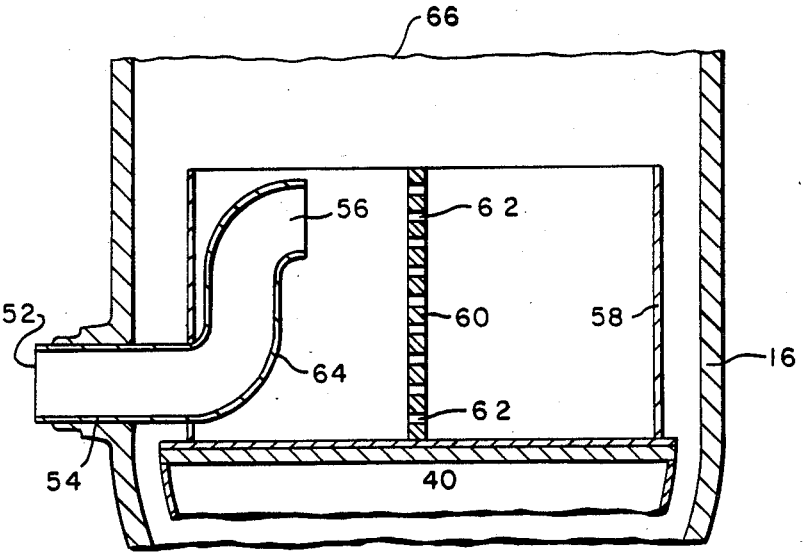
FIG. 3 is a cross section of the feedwater inlet structure of FIG. 2 taken along line III—III.

FIG. 2 is a plan view of a feedwater inlet structure constructed in accordance with one embodiment of the present invention. In this embodiment, a porous baffle 60 has been added to the open channel 58 to minimize swelling of the secondary liquid surface level which may result from the generally horizontal discharge of discharge nozzle 56. This figure also illustrates that channel 58 extends diametrically across the steam generator shell. FIG. 3 is a cross section of the feedwater inlet structure of FIG. 2 taken along line III—III. In this figure, porous baffle 60 is seen to include a plurality of openings 62. The feedwater inlet line 52 also includes a generally vertical portion 64 which provides the necessary elevation of the feedwater discharge nozzle 56 above the generally horizontal feedwater inlet line section 54. The level of the secondary fluid 66 is usually maintained above the top of the channel 58.

By locating the feedwater discharge nozzle at a height some distance above the horizontal section of the feedwater inlet line, the nozzle and feed line piping must be filled by cold inlet water prior to that water being discharged into the steam generator. Therefore, a stratified water distribution would only be possible by way of rapid heating of the inlet water prior to its release from the feedwater inlet line into the steam generator. The open channel structure can be seen to eliminate steam traps such that any steam which may collect within the feedwater introduction structure or be formed within the structure would be permitted to travel upward in its natural circulating direction. In order to allow generated steam to travel upward by natural convection, away from the cold feedwater, the feedwater introduction system allows the steam to escape vertically upward throughout its length.

Using the present invention, thermal shock of the steam generator components can be prevented by providing a physical barrier which prohibits contact of the incoming feedwater with these other components. An appropriate selection of thermal barriers would direct incoming feedwater away from the shell and other components until such time as it was heated or mixed with hot recirculating fluid. The diametral open channel used in this invention is structurally less complex than the J-tube type feedwater ring. In addition, it integrates the feedwater system with the primary separator package and can permit an increased number of riser tubes.

The diametral open channel prevents bubble collapse waterhammer by providing a geometry which is incapable of trapping a steam void. The totally open top portion will allow any steam voids which settle in the channel or which are generated within the channel to rise by natural circulation away from the channel. The elevated inlet nozzle requires the inlet flow to fill the piping and nozzle before any of the inlet water can be released to the steam generator. Therefore, low volume flow cannot in itself cause stratification in the feedwater line since the stratified layer must rise as the elevated portion of the feedwater line fills with cold water. The other mechanism related to stratification, that is, heat transfer to water within the inlet line, is reduced by the fact that the inlet line rises vertically and thus reaches its full height with a minimal heat transfer area exposed to the hot ambient environment. Thermal shock is minimized by directing incoming feedwater directly into the open channel such that it mixes with recirculating water while flowing over the top of the channel and becomes heated. The feedwater then travels circumferentially and radially prior to contacting the upper shell portion.

Although the present invention has been described in terms of what are at present believed to be the preferred embodiment, it will be apparent to those skilled in the art that various changes may be made without departing from this invention. It is therefore intended that the appended claims cover all such changes.

What is claimed is:

1. A vapor generator utilizing a primary fluid to vaporize a secondary fluid, said vapor generator comprising:

a vertically oriented shell portion;

a plurality of U-shaped tubes forming a tube bundle and disposed within said shell portion;

a tube sheet having a plurality of openings disposed therein for receiving the ends of said tubes;

a wrapper encircling said tube bundle and forming an annular passage adjacent to said shell;

an inlet line for introducing said secondary fluid into said shell portion and having a generally horizontal portion;

a discharge nozzle for said secondary fluid, in fluid communication with said inlet line and elevated above said generally horizontal portion of said inlet line;

a channel positioned above said tube bundle for receiving said secondary fluid from said discharge nozzle, said channel having an open top portion which is in fluid communication with said annular passage; and moisture separating means positioned above said channel such that steam formed within said channel passes by natural convection through said open top portion to said moisture separating means.

2. A vapor generator as recited in claim 1, further comprising:

a porous baffle positioned within said channel to distribute the flow of the incoming secondary fluid.

3. A vapor generator as recited in claim 1, wherein the open top portion of said channel is positioned above said discharge nozzle.

4. A vapor generator as recited in claim 1, wherein said channel extends diametrically across said shell portion.

5. A vapor generator as recited in claim 1, wherein said generally horizontal portion of said inlet line extends through said shell portion and into said channel and wherein said inlet line further includes a generally vertical portion which connects said generally horizontal portion to said discharge nozzle.

6. A vapor generator as recited in claim 1, wherein said discharge nozzle is positioned to deliver said secondary fluid horizontally within said channel.

* * * * *